US009397454B2

(12) United States Patent
Lewin et al.

(10) Patent No.: US 9,397,454 B2
(45) Date of Patent: Jul. 19, 2016

(54) ELECTRICAL CONNECTING DEVICE, CONNECTOR KIT, AND METHOD OF ELECTRICALLY CONNECTING TWO APPARATUS

(71) Applicant: Axis AB, Lund (SE)

(72) Inventors: Niclas Moller Lewin, Malmo (SE); Jens Pahlitzsch, Lund (SE); Johan Bergsten, Landskrona (SE)

(73) Assignee: Axis AB, Lund (SE)

( * ) Notice: Subject to any disclaimer, the term of this patent is extended or adjusted under 35 U.S.C. 154(b) by 0 days.

(21) Appl. No.: 14/861,155

(22) Filed: Sep. 22, 2015

(65) Prior Publication Data

US 2016/0093993 A1 Mar. 31, 2016

(30) Foreign Application Priority Data

Sep. 29, 2014 (EP) ..... 14186786

(51) Int. Cl.
*H01R 24/00* (2011.01)
*H01R 24/62* (2011.01)
*H01R 43/16* (2006.01)

(52) U.S. Cl.
CPC ..... *H01R 24/62* (2013.01); *H01R 43/16* (2013.01)

(58) Field of Classification Search
CPC ..... H01R 24/64; H01R 24/62; H01R 23/025; H01R 27/02; H01R 43/16
USPC ..... 439/638, 676
See application file for complete search history.

(56) References Cited

U.S. PATENT DOCUMENTS

| | | | | |
|---|---|---|---|---|
| 4,362,905 | A * | 12/1982 | Ismail | H01R 27/02 439/638 |
| 5,415,559 | A | 5/1995 | Ichimura | |
| 5,462,455 | A | 10/1995 | Reichle | |
| 6,848,911 | B1 * | 2/2005 | Liu | H01R 31/06 439/21 |
| 2002/0001998 | A1 * | 1/2002 | Lo | H01R 31/06 439/502 |

FOREIGN PATENT DOCUMENTS

| | | | |
|---|---|---|---|
| EP | 0 571 879 | A2 | 12/1993 |
| GB | 2 337 375 | A | 11/1999 |
| WO | WO 2014/090365 | A1 | 6/2014 |

OTHER PUBLICATIONS

Extended European Search Report issued Mar. 19, 2015 in European Application 14186786.1, filed on Sep. 29, 2014 (and Written Opinion).

* cited by examiner

*Primary Examiner* — Briggitte R Hammond
(74) *Attorney, Agent, or Firm* — Oblon, McClelland, Maier & Neustadt, L.L.P.

(57) ABSTRACT

The present relates to a connector kit for interconnecting a first and a second apparatus, said first apparatus having a first female connector jack, and said second apparatus having a second female connector jack, and to a method of electrically connecting a first apparatus to a second apparatus.

10 Claims, 6 Drawing Sheets

ELECTRICAL CONNECTING DEVICE, CONNECTOR KIT, AND METHOD OF ELECTRICALLY CONNECTING TWO APPARATUS

TECHNICAL FIELD

The present invention relates to an electrical connecting device. The invention further relates to a connector kit for interconnecting a first and a second apparatus, and to a method of electrically connecting a first apparatus to a second apparatus.

BACKGROUND

There are numerous situations where one apparatus has to be electrically connected to another apparatus. Such connection may be needed for transmitting power, data or both between the apparatus. Generally, such connections are realised using a cable with suitable connectors at the ends. A first connector plug at a first end of the cable is engaged in a first connector jack of the first apparatus, and a second connector plug at a second end of the cable is engaged in a second connector jack of the second apparatus.

However, in some situations it is difficult to connect a cable between the two apparatus. This may be because there is little room for a cable between the apparatus, or because it is hard to see one or both of the connector jacks during connection. One such situation is illustrated in FIG. 1, where a monitoring camera is to be connected to a camera arrangement 2. The illustrated camera arrangement 2 comprises a number of smaller monitoring cameras arranged to provide an overview of an area surrounding the camera 1. The camera 1 is inserted in a lower opening 4 of the camera arrangement 2. The insertion may also be performed by holding the camera 1 and passing the camera arrangement 2 over it, such that the camera 1 is introduced in the lower opening 4 of the camera arrangement 2. Mechanically connecting the camera 1 to the camera arrangement 2 poses no problem using screws 5 passing through holes 6 through the camera arrangement 2 and into threaded holes 7 in the camera 1. Still, electrically connecting the camera 1 to the camera arrangement 2 for transmission of power and/or data is more difficult, because when the camera 1 has been inserted in the opening 4 of the camera arrangement 2, the top surface 8 of the camera, and any connectors thereon, is no longer visible or accessible to the person installing the combined arrangement. Further, if a cable is used for connection, it is difficult to arrange the length of the cable between the camera 1 and the camera arrangement 2. Hence, a need remains for a device and a method simplifying electrical connection of two apparatus in situations where the connecting surfaces of the apparatus are not visible or not accessible to the installer during connection.

In WO 2014/090365, an electrical connecting device for connecting electrical components, such as components of an electrical drive of a motor vehicle, is described. This connecting device has a first contact element for making contact with a corresponding mating contact element of a first component, and a second contact element for making contact with a corresponding mating contact element of a second component. A flexible conductor connects the first and second contact elements electrically, and a housing surrounds the conductor. The housing is designed such as to allow relative movement between a first part accommodating the first contact element and a second part accommodating the second contact element.

SUMMARY OF THE INVENTION

It is an aim of the present invention to provide a connector kit that enables electrical connection of two apparatus, even though connecting surfaces of the apparatus are difficult or impossible to see or access during connection, or space between the apparatus is limited.

It is also an aim of the invention to provide a method that simplifies electrical connection of a first apparatus to a second apparatus when connecting surfaces of the two apparatus are inaccessible or invisible during connection, or there is little free space between the apparatus once connected.

According to a first aspect, these and other aims are achieved, in full or at least in part, by a connector kit for connecting a first apparatus to a second apparatus, said first apparatus having a first female connector jack, and said second apparatus having a second female connector jack, said kit comprising:

an electrical connecting device comprising:

a first connector and a second connector arranged at opposite ends of said connecting device, each connector being adapted for connection with a respective one of said connector jacks, wiring electrically connecting said first connector to said second connector, wherein said first connector and said second connector each comprises a male connector plug, said wiring has a length between said first and second connector plugs which is shorter than a length of each of said connector plugs, and said wiring is enclosed in an enclosure of an elastomeric material providing an elastic deformability to said electrical connecting device, said connector kit further comprising a guide sleeve having a first open end and a second open end, said electrical connecting device being insertable in said sleeve such that said first connector plug faces said first open end and said second connector plug faces said second open end, said sleeve being attachable to said first apparatus such as to surround the first connector jack, said sleeve being insertable in a recess of said second device said electrical connector being movable in said sleeve, said enclosure comprising a flange extending radially outwards from a longitudinal extension of said electrical connecting device, and the flange having an outer circumference which is slightly smaller than an inner circumference of said sleeve.

With such a connector kit, electrical connection of a first and a second apparatus may be simplified. By arranging the connecting device movable in the guide sleeve a risk of the second connector plug missing the second connector jack may be further reduced. Additionally, by arranging the guide sleeve to be insertable in a recess of the second apparatus, connection of the two apparatus may be further simplified.

With such an electrical connector kit it may be possible to connect a first apparatus to a second apparatus without having to see or access the connecting surfaces of the apparatus once connection has commenced. For instance, the first connector plug may be engaged in the first connector jack of the first apparatus, and then the two apparatus may be moved towards each other for connection. The elastic deformability of the connecting device provides a flexibility which makes it possible for the connecting device to compensate for tolerances in the manufacturing of the two apparatus, meaning that the connector jacks of the two apparatus need not always be arranged in the exact same location on each specimen of the apparatus. Further the elastic deformation may make it possible for the connecting device to compensate for slight misalignment of the two apparatus during the connection procedure. Further, the short length of the connecting device makes the connecting device usable even with apparatus that leave little or no space for any connecting cables. Still further, the combination of the short length and the elastic deformability may make it possible to interconnect two connector jacks even if the connector jacks are not visible or accessible to the installer once the connection procedure has been initiated, since there is little risk that the connecting device, once inserted in the first connector jack, is deflected to such extent that it does not end up mating with the second connector jack. By having a bendable length of the wiring between the connector plugs that is shorter than the length of each connector plug, the effective length of the connecting device is short enough to minimise the risk of the connecting device being too severely bent for allowing connection between the two apparatus. This may be particularly useful when at least one of the apparatus to connect is bulky and even heavy, and blocks the view of the connector jacks. It may also be particularly useful when connecting apparatus in hard-to-reach positions, such as when mounting monitoring cameras on high poles. The flange of the connecting device may be useful for flexibly restraining movement of the connecting device.

The first and second connector may each comprise a respective Ethernet connector.

In an embodiment, the Ethernet connectors are arranged without locking tab. In this manner, it may be possible to disconnect the two apparatus after connection, even though the connecting device cannot be accessed.

The elastomeric material may have a hardness of 40-60° Shore A. This may provide a suitable flexibility, such that the connecting device may adapt to tolerances, while still being stable enough not to deflect during connection to such an extent that connection fails.

In an embodiment, the enclosure is moulded over said wiring. This is a practical way of providing a flexible enclosure.

In an embodiment, said sleeve has a cross-sectional shape that is rotationally asymmetric, and that corresponds to a rotationally asymmetric cross-sectional shape of said recess. In this manner, insertion of the sleeve in the recess in a correct rotational orientation may be facilitated.

An outer perimeter of said flange may comprise at least one protrusion or indentation arranged to engage a corresponding indentation or protrusion in said sleeve. This may facilitate insertion of the connecting device in a correct rotational orientation in the sleeve.

The connector kit may further comprise a receiving socket arranged to be attached to said second apparatus such as to surround said second connector jack, said receiving socket having a bevelled opening for receiving and guiding said second connector plug. Secure engagement of the second connector plug in the second connector jack may thereby be facilitated.

The sleeve may comprise at least one lug projecting radially outwardly from an outer surface of said sleeve at said first open end, said at least one lug having a through hole arranged to receive a fastening element for attaching said sleeve to said first apparatus. Attachment of the sleeve to the first apparatus may thereby be facilitated.

According to a second aspect, the abovementioned aims are achieved, in full or at least in part, by a method of connecting a first apparatus to a second apparatus, said first apparatus comprising a first female connector jack, and said second apparatus comprising a second female connector jack, the method comprising the steps of:

arranging an electrical connecting device of a connector kit according to the first aspect in a guide sleeve of said connector kit, said guide sleeve having a first open end and a second open end, said electrical connecting device being arranged with said first connector plug facing said first open end and said second connector plug facing said second open end, attaching said guide sleeve to said first apparatus, such that said guide sleeve surrounds said first connector jack and protrudes from an outer surface of said first apparatus, engaging said first connector plug in said first connector jack, inserting said guide sleeve in a recess of said second apparatus, said second connector jack being arranged in said recess, such that said guide sleeve surrounds said second connector jack, moving said first and second apparatus relatively towards each other until said second connector plug engages said second connector jack.

In this manner, two apparatus may be simply and securely electrically connected to each other, even if the connecting surfaces of the two apparatus are difficult or even impossible for the installer to access or see during the connection procedure. The elastic deformability of the connecting device makes it possible to compensate for tolerances in the exact placement of the connector jacks. Further, by inserting the connecting device in the sleeve, movement of the connecting device may be restrained, such that it is easy to engage the second connector plug in the second connector jack, even though the installer cannot see the plug and the jack. Still further, by arranging the connecting device movably in the sleeve, tolerances may be even further compensated, and possible misalignment of the two apparatus may be accounted for. By inserting the sleeve in the recess of the second apparatus, the connecting procedure may be made even more secure and simple.

A further scope of applicability of the present invention will become apparent from the detailed description given below. However, it should be understood that the detailed description and specific examples, while indicating preferred embodiments of the invention, are given by way of illustration only, since various changes and modifications within the scope of the invention will become apparent to those skilled in the art from this detailed description.

Hence, it is to be understood that this invention is not limited to the particular component parts of the device described or steps of the methods described as such device and method may vary. It is also to be understood that the terminology used herein is for purpose of describing particular embodiments only, and is not intended to be limiting. It must be noted that, as used in the specification and the appended claim, the articles "a," "an," "the," and "said" are intended to mean that there are one or more of the elements unless the context clearly dictates otherwise. Thus, for example, a reference to "an object" or "the object" may include several objects, and the like. Furthermore, the word "comprising" does not exclude other elements or steps.

BRIEF DESCRIPTION OF THE DRAWINGS

The invention will now be described in more detail by way of example and with reference to the accompanying schematic drawings, in which.

DETAILED DESCRIPTION OF EMBODIMENTS

Figure 1:
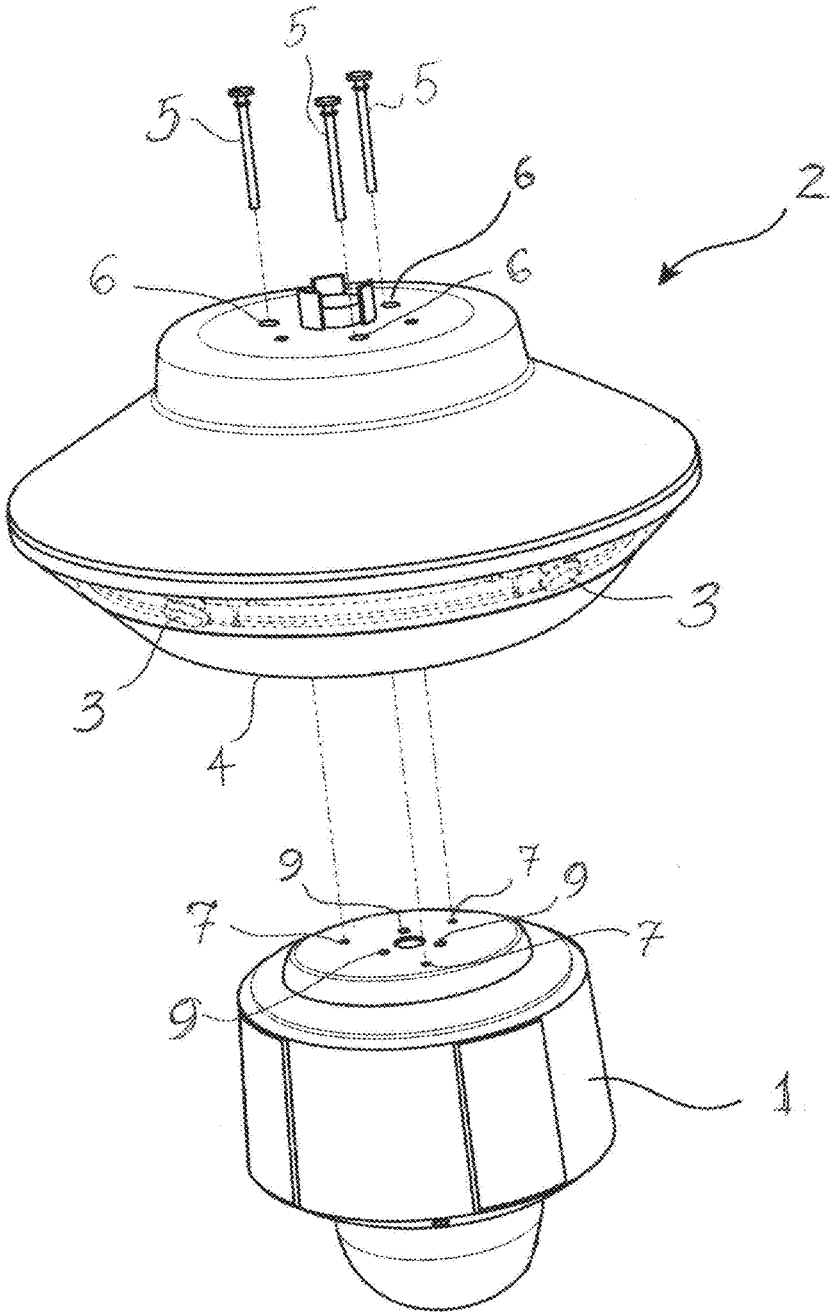
FIG. 1 is a perspective view of a monitoring camera being connected to a camera arrangement.

Reference may once more be made to FIG. 1 showing a camera 1 and a camera arrangement 2 which are to be mechanically and electrically interconnected. The mechanical connection may be achieved using screws 5, such as shown in FIG. 1, and already discussed above. For the electrical connection embodiments of the invention may be employed.

Figure 2:
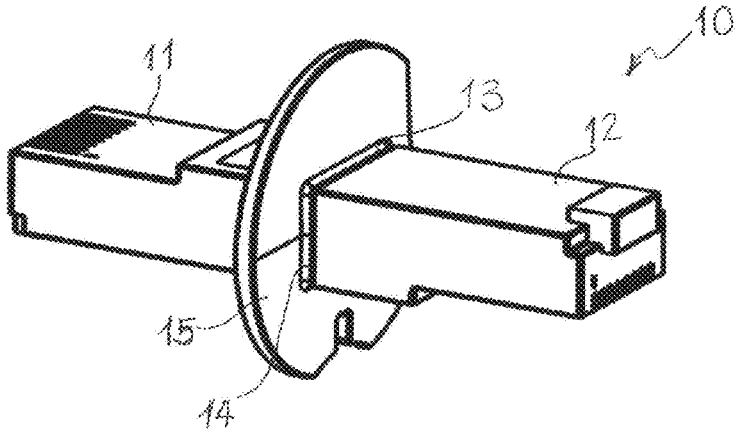
FIG. 2 is a perspective view of an electrical connector according to an embodiment of the invention.

FIG. 2 shows an embodiment of a connecting device 10 which has a generally elongated shape. The connecting device 10 has a first connector 11 and a second connector 12. The first connector is a first male connector plug 11, and the second connector is a second male connector plug 12, both of which in this embodiment are Ethernet connector plugs, or more specifically RJ45 plugs. It should be noted that the Ethernet connector plugs 11, 12 are formed without locking tabs. Thereby, it will be possible to disconnect each connector plug 11, 12 from its respective connector jack even if the connecting device 10 is inaccessible. The connector plugs may be manufactured without locking tab, or the locking tab may be cut off from an ordinary Ethernet connector plug, such as an RJ45 plug. The two connector plugs 11, 12 are connected by wiring not explicitly shown in the drawings, but indicated by the reference 13. The wiring 13 is enclosed by an enclosure 14 made of elastomeric material. The enclosure has a flange 15, which extends radially outwards from the longitudinal extension of the connecting device 10. The enclosure 14 has been moulded over the wiring 13. During moulding, the elastomeric material has also flowed into the interior of the connector plugs 11, 12, filling the interior of the connector plugs 11, 12. In this embodiment, the enclosure is moulded from a thermoplastic elastomeric vulcanisate (TPE-V) with a hardness of 49° Shore A.

Figure 3:
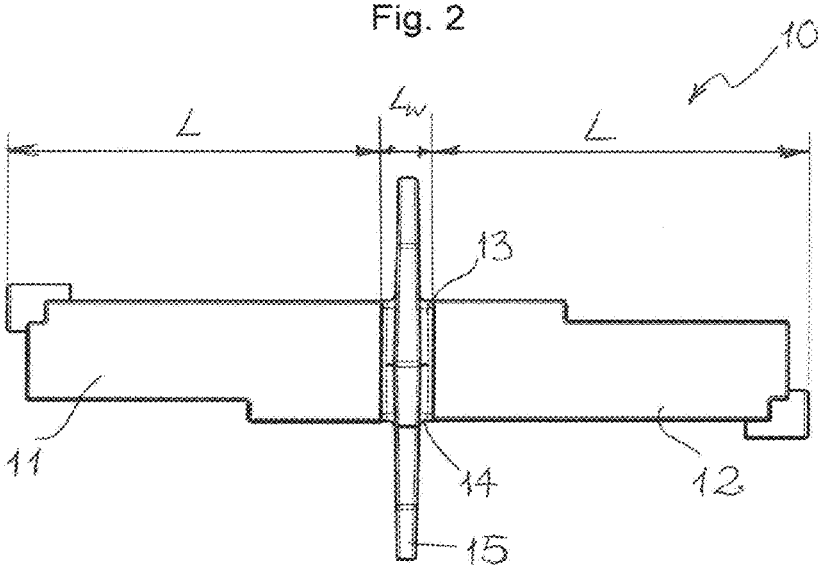
FIG. 3 is a side view of the electrical connector shown in FIG. 2.

As may be seen from FIG. 2, and more particularly from FIG. 3, the wiring 13 connecting the first and second connector plugs 11, 12 is short compared to a length L of each of the connector plugs 11, 12. In this embodiment, the flexible or bendable length $L_w$ of the wiring extending between the connector plugs 11, 12 is only a few millimetres. It should be noted that the wiring extends also into the connector plugs 11, 12, such that the total length of the wiring from an outer end of the first connector plug 11 to an outer end of the second connector plug 12 is significantly longer.

Figure 4:
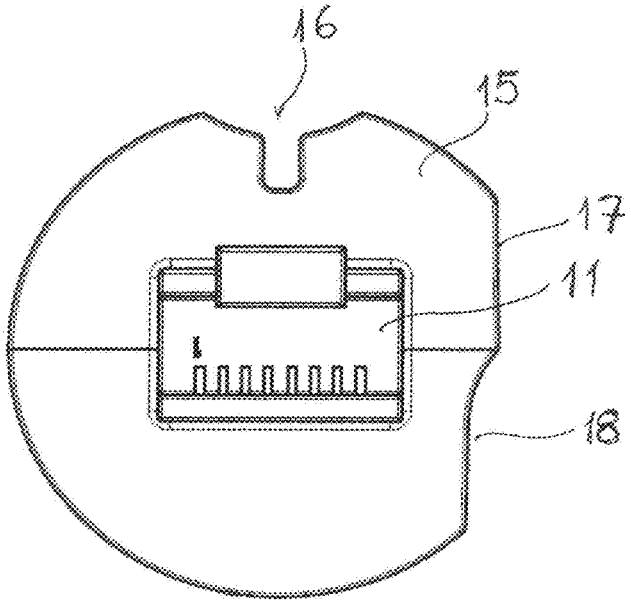
FIG. 4 is an end view of the electrical connector of FIG. 2.

The flange 15 of the enclosure 14 may be seen more clearly in FIG. 4. The flange 15 has an overall circular shape with a first indentation 16 shown at the top of FIG. 4, a straight portion 17 at the right, and a second indentation 18 in the lower right part of the view in FIG. 4. The reasons for this shape will be discussed further below.

The connecting device 10 may be used for electrically connecting a first apparatus to a second apparatus. The first connector plug 11 will first be engaged in a first connector jack of the first apparatus. The first and second apparatus will then be moved relatively towards each other until the second connector plug engages a second connector jack of the second apparatus. The first apparatus may for instance be a monitoring camera, such as the camera 1 shown in FIG. 1, and the second apparatus may be a camera arrangement such as the camera arrangement 2 shown in FIG. 1.

During such a connecting procedure, the flexibility of the connecting device 10 provided by the elastomeric enclosure 14 enclosing the wiring 13, may allow the connecting device 10 to adapt to tolerances in the exact shape and placement of the connector jacks of the two apparatus. The short length of the wiring will make it easy to fit the connector between the two apparatus, and will also reduce a risk of the connecting device deflecting to such an extent that the second connector plug 12 does not mate with the second connector jack.

Still, in situations where it is difficult to see or access the connecting surfaces of the two apparatus to be connected, it may be beneficial to use a connector kit 20, which will now be described with reference to FIGS. 5-8.

Figure 5:
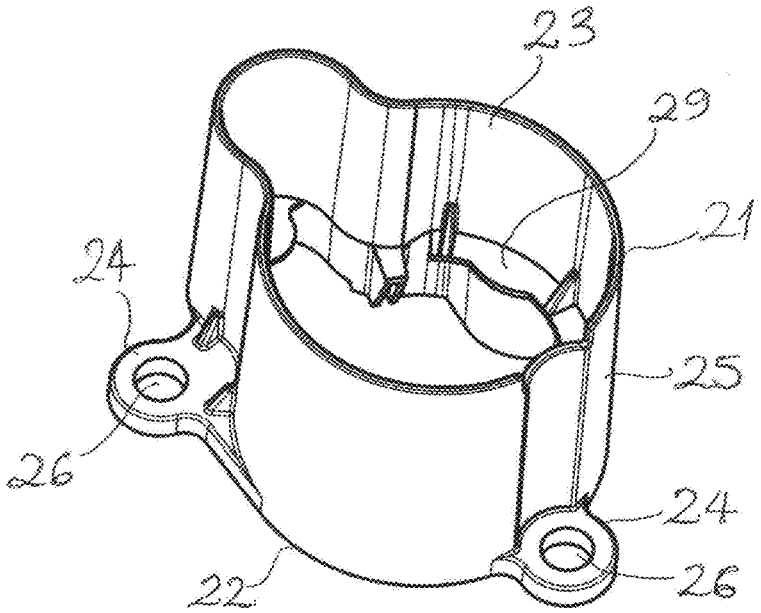
FIG. 5 is a perspective view of a sleeve of a connector kit according to an embodiment of the invention.
Figure 6:
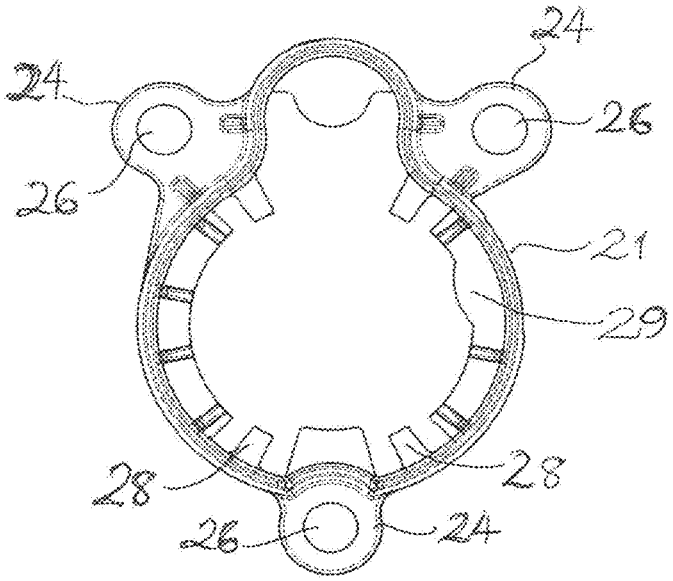
FIG. 6 is a top view of the sleeve of FIG. 5.

The connector kit 20 includes a guide sleeve 21, which may be seen more clearly in FIGS. 5 and 6. The guide sleeve 21 has a first open end 22 and a second open end 23. At the first open end 22 three lugs 24 extend radially outwardly from a circumferential surface 25 of the sleeve 21. A through hole 26 is provided in each lug 24. The sleeve 21 has a cross-sectional shape that is rotationally asymmetric. The particular shape is chosen so as to correspond to features on the first apparatus and the second apparatus. In this embodiment, the positions of the through holes 26 of the lugs 24 match threaded holes 9 in the top surface 8 of the monitoring camera 1. Further, the shape of the circumferential surface 25 of the sleeve 21 corresponds to an inner shape of a recess of the camera arrangement 2.

Figure 7:
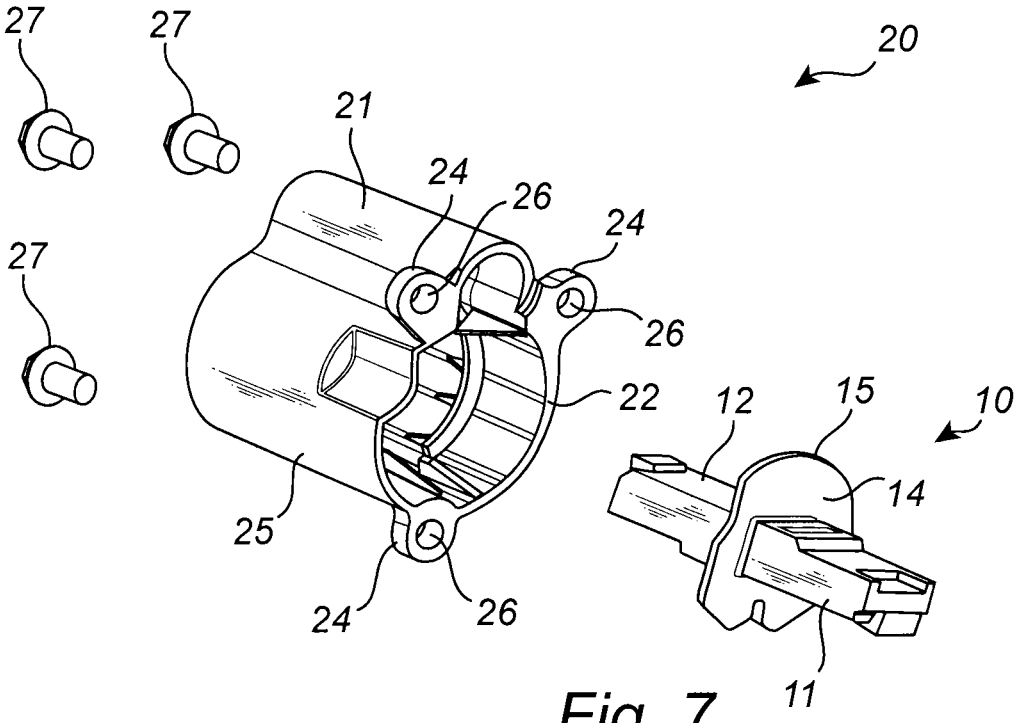
FIG. 7 is an exploded view of a connector kit according to an embodiment of the invention.
Figure 8:
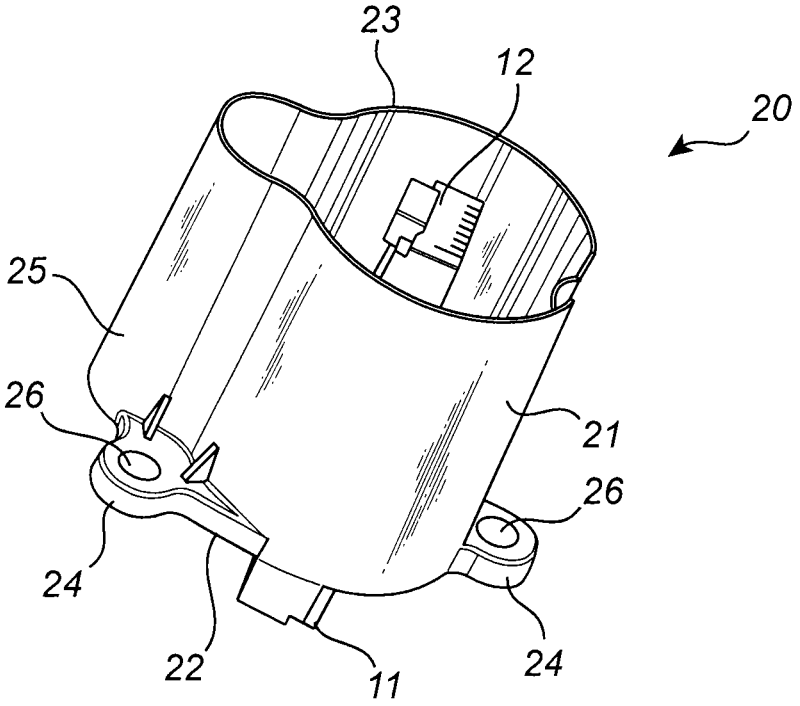
FIG. 8 is a perspective view of the connector kit of FIG. 7 assembled.

The connector kit 20 also includes the connecting device 10. In FIG. 7 an exploded view of the connector kit 20 may be seen, here also including three screws 27 adapted to the through holes 26 in the lugs 24 of the sleeve 21. The connector kit 20 may be delivered as separate parts, or it may be delivered assembled in preparation for connection. When assembling the connector kit 20, the connecting device 10 is inserted in the sleeve 21. The outer perimeter of the flange 15 will with its particular shape fit inside the sleeve if placed in the correct orientation. The first indentation 16 of the flange will engage two first protrusions 28 on the inside of the sleeve 21, and the second indentation 18 of the flange will engage a second protrusion 29 on the inside of the sleeve 21. Because the flange 15 has an outer circumference which is slightly smaller than an inner circumference of the sleeve 21, and because the flange 15 is flexible, the connecting device 10 may move slightly inside the sleeve 21. As may best be seen in FIG. 5, there are protrusions at different distances from the open ends 22, 23 of the sleeve, Hereby, the flange 15 of the connecting device 10 may be held between the protrusions.

When connecting a first apparatus, such as the camera 1, to a second apparatus, such as the camera arrangement 2, the sleeve 21 may be attached to the camera 1 by means of the screws 27 screwed through the through holes 26 in the lugs 24 of the sleeve 21 and into the corresponding holes 9 in the top surface 8 of the camera 1. In this embodiment, the through holes 26 form a non-equilateral triangle. Therefore, the sleeve 21 can only be screwed onto the camera 1 in one orientation. The rotationally asymmetric cross sectional shape of the sleeve 21 ensures that the sleeve can only be inserted in one orientation in the correspondingly shaped recess in the camera arrangement 2. Thus, it may be ensured that the camera 1 and the camera arrangement 2 are connected at a correct rotational angle. This in turn ensures that the connector plugs 11, 12 may be safely inserted in the connector jacks of the respective apparatus.

Figure 9:
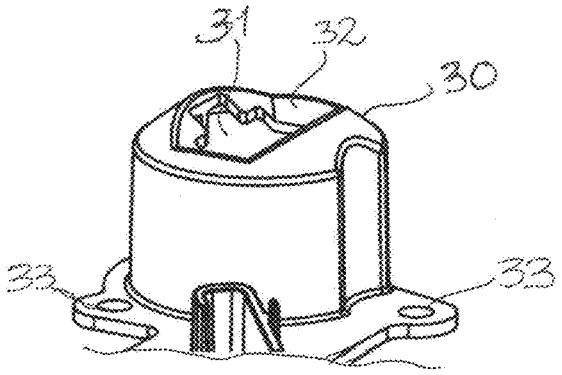
FIG. 9 is a perspective view of a receiving socket of a connector kit according to another embodiment of the invention.

In order to make connection of the two apparatus even easier and safer, a receiving socket 30 as shown in FIG. 9 may be included in the connector kit 20. The receiving socket 30 has an opening 31 for receiving a connector plug. Around the opening 31 bevelled surfaces 32 are formed for guiding the connector plug into the opening. The receiving socket 30 has through holes 33 for attaching the receiving socket 30 to the second apparatus, i.e. the camera arrangement 2, in the recess of the camera arrangement 2.

A method of connecting the camera 1 to the camera arrangement 2 will now be described. Unless the connector kit 20 has been delivered already assembled, the connecting device 10 is first inserted in the guide sleeve 21, with the indentations 16, 18 and the protrusions 28, 29 simplifying inserting in the correct orientation. The sleeve 21 is attached to the top surface 8 of the camera 1 by screwing the screws 27 through the holes 26 in the lugs 24 of the sleeve 21 into the holes 9 in the camera 1. The sleeve 21 will then surround a first connector jack in the top surface 8 of the camera 1. The first connector plug 11 is engaged in the first connector jack. The connecting device 10 is now safely enclosed in the sleeve 21.

The camera 1 and the camera arrangement 2 are moved towards each other and the sleeve 21 is inserted in a recess in the opening 4 of the camera arrangement 2. As already mentioned, the rotationally asymmetric cross-sectional shape of the sleeve 21 corresponding to a shape of the recess in the camera arrangement 2 helps ensure that the camera 1 and the camera arrangement 2 are connected in a correct rotational relation.

The camera 1 and the camera arrangement 2 are moved closer together until the second connector plug 12 is inserted in the bevelled opening 31 of the receiving socket 30 and then engages a second connector jack in the recess of the camera arrangement 2. Thereby, the camera 1 and the camera arrangement 2 are electrically connected. The camera 1 and the camera arrangement 2 may then be mechanically connected using the screws 5, such as discussed in the background section above.

During a connection procedure in accordance with the method described above, the elastic deformability or flexibility of the connecting device 10 will allow the connecting device 10 to adapt to variations in the exact positioning of the connector jacks of the respective apparatus. Such variations are due to tolerances in the manufacturing processes. These tolerances may lead to variations in position in all directions. By allowing the connecting device 10 to bend slightly and move inside the sleeve 21, variations of the positions in a plane parallel to the top surface 8 of the camera 1 may be adapted to. Further, the flexibility of the enclosure 14 may allow the connecting device to be slightly compressed, such that variations in position in a direction generally perpendicular to the top surface 8 of the camera 1 may be accounted for.

Further, when the camera 1 and the camera arrangement 2 are screwed together using the screws 5, tolerances may again give rise to deviations in the exact positions of the holes 6 in the camera arrangement 2 and the holes 7 in the camera 1, such that the camera 1 and the camera arrangement 2 have to be rotated slightly in relation to each other. The flexibility of the connecting device 10 may in such case allow the connecting device to twist a little to compensate for such tolerances.

It will be appreciated that a person skilled in the art can modify the above described embodiments in many ways and still use the advantages of the invention as shown in the embodiments above. As an example, the connecting device may be made without a flange. This may be useful in case the connecting device is not arranged in any guiding sleeve, or if the connecting device is arranged in a narrower sleeve only slightly wider than a circumference of the connector plugs.

Generally, the elastomeric material of the enclosure may have a hardness of 40-60° Shore A. However, in some embodiments, a softer material may be used. This may be advantageous in case the two apparatus have to be able to move in relation to each other after installation, for instance in an environment with a lot of vibration, such as in a moving bus. A harder material may be chosen when tolerances are stricter, such that the connecting device does not have to be able to deform as much. The hardness of the elastomeric material should be adapted to the specific situation, such that it is soft enough for the connecting device to be able to adapt to the tolerances, and hard enough not to deform to such extent that the connector plugs do not engage with their respective connector jacks when connecting the two apparatus.

The enclosure may also be made of other elastomeric materials, such as natural rubber or silicone.

The sleeve and the receiving socket will generally be made of a rigid plastic material, such as a thermoplastic material, e.g., a polycarbonate/acrylonitrile-butadiene-styrene blend (PC/ABS).

In the example described above, the connector plugs are Ethernet connectors. Ethernet cables are generally formed as twisted pair cables. In the embodiment shown in FIGS. 2-4 the wiring is very short, and there will therefore in most cases not be any need for twisting the wires. Still, if the wiring is made longer between the connector plugs, up to the length of one of the connector plugs, the wires will have to be twisted. This may be done using a twist rate known per se. Care should be taken when choosing the hardness of the elastomeric material enclosing the wiring, such that the maximum pulling tension and the minimum bending radius specified for the specific twisted pair wiring are not surpassed.

The length of the wiring is to be chosen dependent on the distance between the connector jacks of the two apparatus when connected.

Instead of Ethernet connector plugs, the connection device may be provided with other connector plugs, such as HDMI plugs, USB plugs, DIN plugs, or RCA plugs, or any other male connectors for electrical connection.

It should be noted that the recess in the second apparatus need not be integrated in the body of the second apparatus. Instead, a sleeve may be attached to second apparatus for forming the recess, in a manner similar to the guide sleeve attached to the first apparatus.

A particular configuration of indentations and protrusions on the flange of the connecting device and in the guide sleeve has been shown on the drawings. However, it should be understood that other configurations are also possible. For instance there may be protrusions on the flange corresponding to indentations in the sleeve, and there may be both indentations and protrusions on the flange corresponding to protrusions and indentations, respectively, in the sleeve. The protrusions and indentations may have any shape that will help the installer insert the connecting device in the sleeve in a correct orientation.

In the context described above, the apparatus that are being connected are a monitoring camera and a camera arrangement. It should be noted that other apparatus may be connected as well using the inventive connecting device, connector kit or connecting method. Generally, the invention will be useful in any situation where two apparatus are to be connected electrically, and the connection surfaces are hard to see or access during connection, i.e. where the connection has to be made blindly.

Thus, the invention should not be limited to the shown embodiments but should only be defined by the appended claims.

The invention claimed is:

1. A connector kit for connecting a first apparatus to a second apparatus, said first apparatus having a first female connector jack, and said second apparatus having a second female connector jack, said kit comprising:

an electrical connecting device comprising:

a first connector and a second connector arranged at opposite ends of said connecting device, each connector being adapted for connection with a respective one of said connector jacks, wiring electrically connecting said first connector to said second connector, wherein said first connector and said second connector each comprises a male connector plug, said wiring has a length between said first and second connector plugs which is shorter than a length of each of said connector plugs, said wiring is enclosed in an enclosure of an elastomeric material providing an elastic deformability to said electrical connecting device, wherein said connector kit further comprises:

a guide sleeve having a first open end and a second open end, said electrical connecting device being insertable in said sleeve such that said first connector plug faces said first open end and said second connector plug faces said second open end, said sleeve being attachable to said first apparatus such as to surround the first connector jack, said sleeve being insertable in a recess of said second apparatus, said electrical connecting device is movable in said sleeve, said enclosure comprises a flange extending radially outwards from a longitudinal extension of said electrical connecting device, and in that said flange has an outer circumference which is slightly smaller than an inner circumference of said sleeve.

2. The connector kit as claimed in claim 1, wherein said first and second connector each comprises a respective Ethernet connector plug.

3. The connector kit as claimed in claim 2, wherein said Ethernet connector plugs are arranged without a respective locking tab.

4. The connector kit as claimed in claim 1, wherein said elastomeric material has a hardness of 40-60° Shore A.

5. The connector kit as claimed in claim 1, wherein said enclosure is moulded over said wiring.

6. The connector kit as claimed in claim 1, wherein said sleeve has a cross-sectional shape that is rotationally asymmetric, and that corresponds to a rotationally asymmetric cross-sectional shape of said recess.

7. The connector kit as claimed in claim 1, wherein an outer perimeter of said flange comprises at least one protrusion or indentation arranged to engage a corresponding indentation or protrusion in said sleeve.

8. The connector kit as claimed in claim 1, further comprising a receiving socket arranged to be attached to said second apparatus such as to surround said second connector jack, said receiving socket having a bevelled opening for receiving and guiding said second connector plug.

9. The connector kit as claimed in claim 1, wherein said sleeve comprises at least one lug projecting radially outwardly from an outer surface of said sleeve at said first open end, said at least one lug having a through hole arranged to receive a fastening element for attaching said sleeve to said first apparatus.

10. A method of connecting a first apparatus to a second apparatus, said first apparatus comprising a first female connector jack, and said second apparatus comprising a second female connector jack, the method comprising the steps of:

arranging an electrical connecting device of a connector kit as claimed in claim 1 in said guide sleeve of said connector kit, with said first connector plug facing said first open end and said second connector plug facing said second open end, attaching said guide sleeve to said first apparatus, such that said guide sleeve surrounds said first connector jack and protrudes from an outer surface of said first apparatus, engaging said first connector plug in said first connector jack, inserting said guide sleeve in a recess of said second apparatus, said second connector jack being arranged in said recess, such that said guide sleeve surrounds said second connector jack, moving said first and second apparatus relatively towards each other until said second connector plug engages said second connector jack.

* * * * *